US006371826B1

(12) United States Patent
Pestonji

(10) Patent No.: US 6,371,826 B1
(45) Date of Patent: Apr. 16, 2002

(54) PLUSH ANIMAL FIGURE HAVING MOVING EARS AND NOSE

(75) Inventor: Danny Pestonji, Burbank, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/633,028

(22) Filed: Aug. 4, 2000

(51) Int. Cl.[7] ..... A63H 3/36

(52) U.S. Cl. ..... 446/337; 446/298; 446/300; 446/369

(58) Field of Search ..... 446/297, 298, 446/300, 301, 330, 337, 339, 340, 352, 353, 369, 370, 371, 372

(56) References Cited

U.S. PATENT DOCUMENTS

| | | | | | |
|---|---|---|---|---|---|
| 2,137,371 | A | | 11/1938 | Marsh | |
| 3,014,309 | A | | 12/1961 | Carroll | |
| 4,516,951 | A | | 5/1985 | Saigo et al. | |
| 4,582,499 | A | * | 4/1986 | Saigo et al. | 446/304 |
| 4,699,603 | A | * | 10/1987 | Saigo et al. | 446/304 |
| 4,840,602 | A | | 6/1989 | Rose | |
| 4,923,428 | A | | 5/1990 | Curran | |
| 4,944,708 | A | * | 7/1990 | Kawabe | 446/175 |
| 5,141,464 | A | | 8/1992 | Stern et al. | |
| 5,267,886 | A | * | 12/1993 | Wood et al. | 446/175 |
| 5,304,087 | A | | 4/1994 | Terzian et al. | |
| 5,324,225 | A | | 6/1994 | Satoh et al. | |
| 5,374,216 | A | * | 12/1994 | Jung et al. | 446/175 |
| 5,376,038 | A | | 12/1994 | Arad et al. | |
| 5,607,336 | A | | 3/1997 | Lebensfeld et al. | |
| 6,123,598 | A | * | 9/2000 | Cook | 446/337 |

* cited by examiner

*Primary Examiner*—Jacob K. Ackun, Jr.
*Assistant Examiner*—Faye Francis
(74) *Attorney, Agent, or Firm*—Roy A. Ekstrand

(57) ABSTRACT

A plush toy animal figure defines a shape corresponding to a fanciful four-legged animal having a pair of elongated ears and a large head and nose. A movement mechanism supported within the plush animal figure includes a battery-powered motor drive and gear apparatus which is operatively coupled to a pair of elongated rigid ear paddles within each of the figures ears. A third paddle is supported within the head and nose of the figure and is operatively coupled to the gear drive. A pair of cams are moved by the drive mechanism and are used to actuate a pair of reversing switches. The reversing switches produce a reversal of drive motor direction each time they are actuated. The cams are positioned such that they alternate the actuation of their respective reversing switches. As a result, the motor is reversed when the ears and nose of the figure reach their upper and lower points of pivotal movement.

4 Claims, 2 Drawing Sheets

PLUSH ANIMAL FIGURE HAVING MOVING EARS AND NOSE

FIELD OF THE INVENTION

This invention relates generally to animated toy figures and particularly to those utilizing a plurality of movement mechanisms within a common internal housing.

BACKGROUND OF THE INVENTION

Through the years, a wide variety of toy figures and dolls have been created for entertainment. Such toy figures and dolls have assumed shapes replicating humans, human infants, animals as well as fanciful characters. In their efforts to increase the amusement and play value of such toy figures and dolls, practitioner's in the art have created a variety of toy figures and dolls having movable features and are articulated bodies and limbs. In addition, such articulated and movable figures have been, in some instances, provided with motion energy sources such as wind-up motors or battery-driven electrical motors. A result has been to provide a variety of movable toy figures and dolls.

Another improvement in the continuing efforts of practitioner's in the toy arts to provide increased amusement and play value has been found in the creation of toy figures and dolls which respond to external stimulus. Practitioner's have, in such efforts, provided toy figures and dolls which respond to external stimulous such as sounds, touch or contact with external articles such as another doll or toy figure. Numerous examples of such movable and articulated toy figures and dolls responsive to stimulous are found in the art. For example, U.S. Pat. No. 5,141,464 issued to Stern et al. sets forth a TOUCH RESPONSIVE ANIMATED TOY FIGURE having a four-legged plush animal supporting a movable head and an internal drive mechanism for providing angular movement of the head. An extendable tongue is supported within the head and extends and retracts as the head undergoes pivoting movement. A touch sensor is positioned at the animals upper back to trigger an operational interval each time child user touches the back of the toy figure.

U.S. Pat. No. 4,516,951 issued to Saigo et al. sets forth a movable toy animal having a toy figure resembling a bunny or the like supporting a motor driven internal movement mechanism. The movement mechanism is operatively coupled to a pair of movable ears and a movable nose. When operated, the ears and nose undergo a predetermined movement cycle.

U.S. Pat. No. 5,304,087 issued to Terzian et al. sets forth a SOFT STUFFED TOY WITH MANUALLY DRIVEN HEAD, EARS AND/OR TONGUE carried in a flexible sling with the head of the figure exposed. The head includes animatable ears driven by rotation of the head relative to the body. In addition, the protuding movable tongue is driven by an actuator which also provides rotation of the head relative to the body.

U.S. Pat. No. 5,324,225 issued to Satoh et al. sets forth an INTERACTIVE TOY FIGURE WITH SOUND-ACTIVATED AND PRESSURE-ACTIVATED SWITCHES having a toy animal figure which resembles a kitten and which includes a multiply jointed rearwardly extending tail. A pullstring mechanism is operative within the tail under the drive of an internal battery-powered motor to cause wagging of the tail.

U.S. Pat. No. 2,137,371 issued to Marsh and U.S. Pat. No. 3,014,390 issued to Carroll set early examples of dolls and toy figures having movable appendages.

In a related art, a plurality of dolls have been provided which include speech or sound capabilities. These prior art devices are illustrated in U.S. Pat. No. 5,376,038 issued to Arad et al.; U.S. Pat. No. 4,923,428 issued to Curran; U.S. Pat. No. 4,840,602 issued to Rose; and U.S. Pat. No. 5,607,336 issued to Lebensfeld et al.

While the foregoing described prior art devices have to some extent improved the art and have in some instances enjoyed commercial success, there remains nonetheless and continuing need in the art for evermore improved, interesting and amusing animal figures having movable components.

SUMMARY OF THE INVENTION

Accordingly, it is a general object of the present invention to provide an improved plush animal figure. It is a more particular object of the present invention to provide an improved plush animal figure having moving ears and nose utilizing a compact and efficient movement mechanism.

In accordance with the present invention there is provided a plush toy comprising: a plush animal body having a head, a pair of ears, a nose, a torso and a plurality of legs; a pair of elongated ear paddles within the ears, each of the ear paddle having an interior ear paddle end; an elongated nose paddle extending through the head and into the nose, the nose paddle defining a nose paddle interior end; a pair of ear paddle supports coupled to the interior ear paddle ends pivotably supporting the pair of ears for movement between raised and lowered ear positions; a nose paddle support coupled to the nose paddle interior end pivotably supporting the nose paddle between a raised position and a lowered position; a housing supported within the torso supporting the pair of ear paddle supports and the nose paddle support; a battery supply and reversible motor supported within the housing and a gear drive operatively coupling the reversible motor to the nose paddle support and the pair of ear paddle supports moving the ear paddles and the nose paddle between the respective raised and lowered ear positions and the raised and lowered nose position; a pair of reversing switches supported within the housing operative in response to movement of the pair of ear supports to reverse the motor at the raised and lowered ear positions; and a switch within the plush animal body actuated in response pressure to energize the motor.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
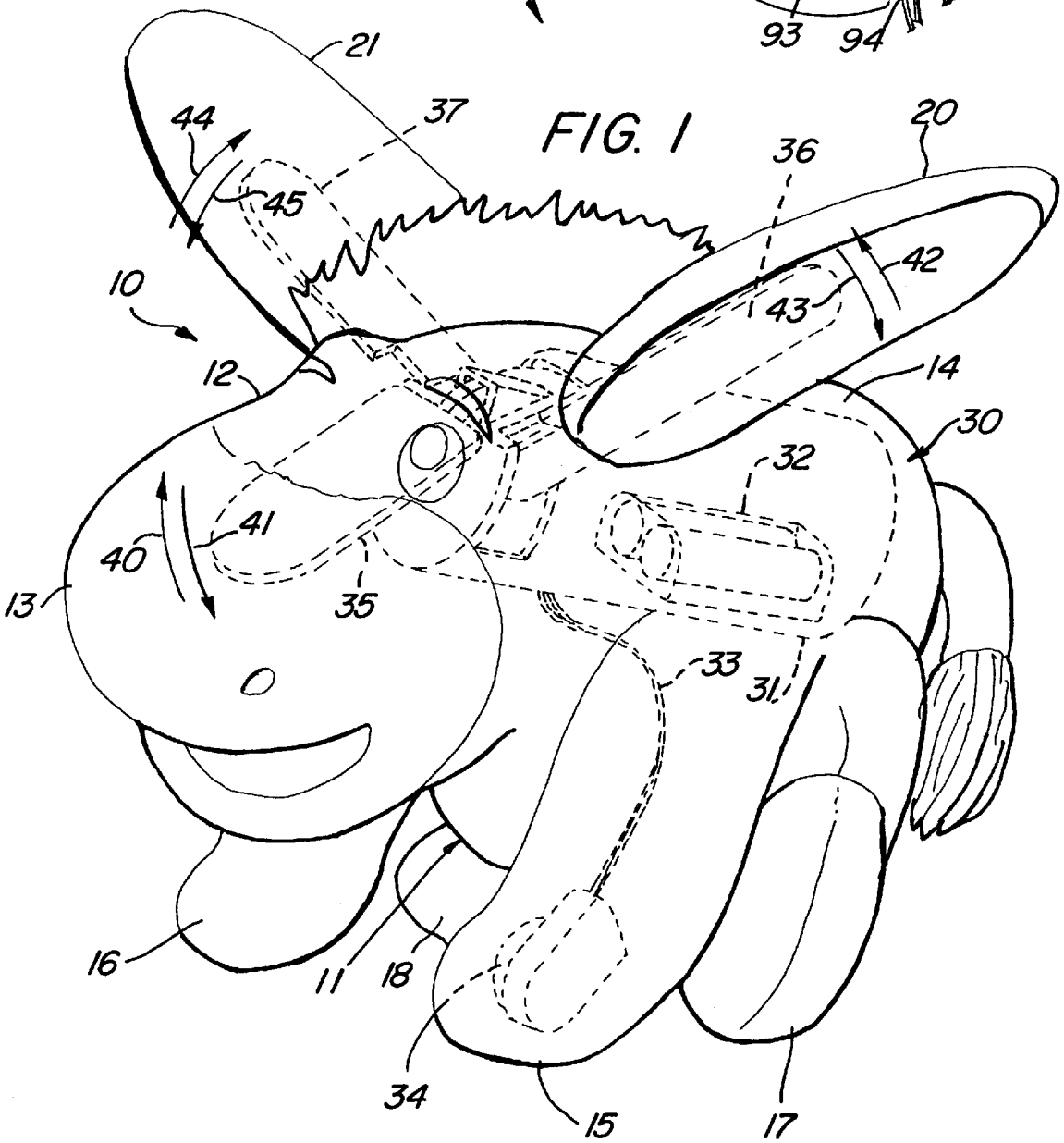
FIG. 1 sets forth a front perspective view of a plush toy animal figure constructed in accordance with the present invention showing the movement mechanism in phantom line depiction.

FIG. 1 sets forth a front perspective view of a plush animal figure constructed in accordance with the present invention and generally referenced by numeral 10. Animal FIG. 10 is formed as a plush figure having a soft padded plush body 11 defining a torso 14, a head 12 supporting a nose 13, a plurality of supporting legs 15, 16, 17 and 18 and a pair of ears 20 and 21. A pressure responsive switch 34 is supported within leg 15 and is operatively coupled to a connecting wire set 33.

In accordance with the present invention, a movement mechanism 30 is supported within plush body 11 and includes a housing 31 supporting a plurality of conventional batteries 32. Movement mechanism 30 further includes a nose paddle 35 operatively coupled to the drive apparatus within movement mechanism 30 set forth below in FIGS. 2 and 3. Suffice it to note here, that nose paddle 35 is movable in the directions indicated by arrows 40 and 41. In further accordance with the present invention, movement mechanism 30 supports a pair of ear paddles 36 and 37 which are also operatively coupled to the drive mechanism with movement mechanism 30 set forth below in FIGS. 2 and 3. Suffice it to note here, that ear paddle 36 is movable in the directions indicated by arrows 42 and 43 while ear paddle 37 is movable in the directions indicated by arrows 44 and 45.

Figure 3:
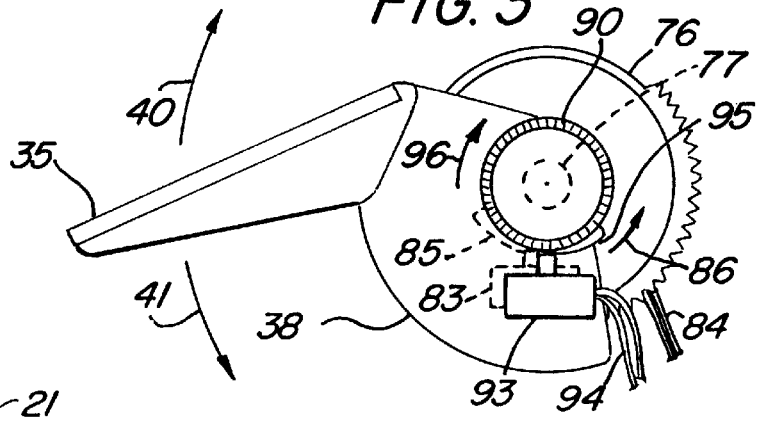
FIG. 3 sets forth a partial section view of the movement mechanism of the present invention plush animal figure taken along section lines 3—3 in FIG. 2.

In operation, and by means set forth below in FIGS. 2 and 3 in greater detail, animal FIG. 10 responds to actuation of pressure switch 34 when the user squeezes leg 15 to energize the motor drive within movement mechanism 30 provided by a reversible motor 60 (seen in FIG. 2) supported with housing 31. By means also set forth below in greater detail, the movements of nose paddle 35 and ear paddles 36 and 37 is synchronized such that upward movement of nose paddle 35 in the direction indicated by arrow 40 is accompanied by simultaneous upward movement of ear paddles 36 and 37 in the directions indicated by arrows 42 and 44 respectively. conversely, downward movement of nose paddle 35 in the direction indicated by arrow 41 is accompanied by a corresponding downward movement of ear paddles 36 and 37 in the directions indicated by arrows 43 and 45.

Thus, as the user squeezes leg 15 energizing pressure switch 34, nose 13 of plush body 11 is moved up and down in the directions indicated by arrows 40 and 41 while ears 20 and 21 of plush body 11 are simultaneously moved upwardly in the directions indicated by arrows 42 and 44 and downwardly in the directions indicated by arrows 43 and 45. This movement continues for a predetermined time after which movement terminates and awaits the next actuation of pressure switch 34.

Figure 2:
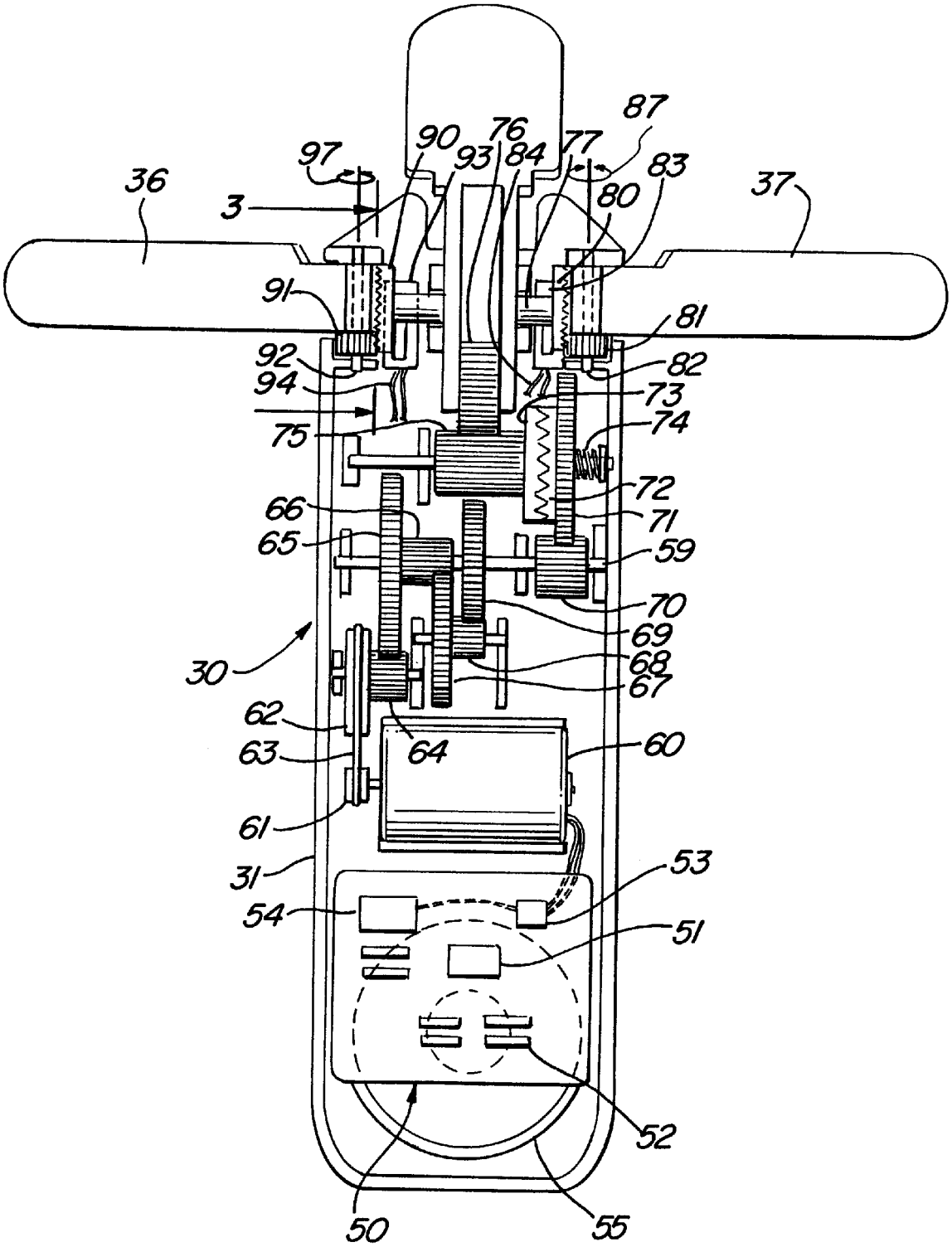
FIG. 2 sets forth a section view of the movement mechanism of the present invention plush animal figure.

As is seen in FIG. 2, movement mechanism 30 supports a sound and control circuit 50. Accordingly, the activation of drive motor 60 (also seen in FIG. 2) to move nose 13 and ears 21 and 22 is accompanied by an audible message or series of messages produced by sound and control circuit 50 (seen in FIG. 2). Thus, as animal FIG. 10 is activated, the user is provided with an amusing and interesting animation and sound play pattern.

FIG. 2 sets forth a section view of movement mechanism 30 in which housing 31 is sectioned to facilitate the illustration of the internal drive apparatus of mechanism 30. Accordingly, a reversible motor 60 includes an output pully 61 having an endless belt 63 coupled thereto. Movement mechanism 30 further includes a pully 62 also coupled to belt 63. Pully 62 supports a gear 64 which in turn in coupled to a gear 65. Gear 65 further supports a gear 66 which in turn is coupled to a gear 67. Gear 67 supports a gear 68 which is coupled to a gear 69. A shaft 59 is rotatably supported within housing 31 and is joined to gear 69. Gears 65 and 66 are rotatably supported upon shaft 59 but are freely rotatable thereon and are not joined to shaft 59. Shaft 59 is further joined to a gear 70. As a result, the rotation of gear 68 causes the combination of gear 69, shaft 59 and gear 70 to rotate as a single rotational single member. The rotation of gear 70 further rotates gear 71. Gear 71 supports a clutch member 72. A cooperating clutch member 73 engages clutch member 72 and is joined to a gear 75. A spring 74 provides a spring force against gear 71 urging clutch member 72 into engagement with clutch member 73. The function of clutch members 72 and 73 and spring 74 is a protective function in which undo stresses opposed upon the drive mechanism such as would be encountered should the child user hold one or more of paddles 35, 36 and 37 while motor 60 is energized, damage to drive apparatus is avoided as clutch members 72 and 73 disengage.

The rotation of gear 75 produces a corresponding rotational movement of sector gear 76. It will be noted that sector gear 76 is not a complete gear but is merely a sector gear. This use of a sector gear is enabled by the reversing mechanism set forth below in FIG. 3. Suffice it to note here, that motor 60 is repeatedly reversed causing gear 75 to repeatedly reverse its direction of its rotation within the span of gear teeth on sector gear 76.

Sector gear 76 is joined to a shaft 77 which is rotatably supported within housing 31. Shaft 77 is coupled to a further pair of gears 80 and 90 on each end thereof. Thus, pivotal movement of sector gear 76 produces a corresponding rotation of gears 80 and 90. A shaft 82 is rotatably supported by housing 31 in the directions indicated by arrows 87. Shaft 82 supports a gear 81 engaging gear 80. Gear 81 is integrally formed with ear paddle 37 such that rotation of gear 81 produces a corresponding pivotal movement of ear paddle 37.

Correspondingly, a shaft 92 is rotatably supported within housing 31 in the directions indicated by arrows 97. Gear 91 is integrally formed with ear paddle 36 such that movement of gear 91 produces corresponding pivotal movement of ear paddle 36. Thus, as gear 91 is rotated in response to rotation of gear 90, ear paddle 36 is pivoted about shaft 92 in the manner indicated by arrows 97.

A nose paddle 35 is joined to sector gear 76 such that partial rotation in a reversible manner of sector gear 76 about shaft 77 produces a corresponding pivotal movement of nose paddle 35. The pivotal movement of nose paddle 35 is shown by directional arrows 40 and 41 in FIG. 3.

A pair of reversing switches 83 and 93 are positioned beneath gears 80 and 90 respectively in the manner set forth below in FIG. 3. Suffice it to note here, that switches 83 and 93 are operatively coupled to reversible motor 60 via sound and control circuit 50 by a plurality of coupling wires 84 and 94 respectively. The connection of wires 84 and 94 to sound and control circuit 50 is omitted to avoid unduly cluttering the drawing figure. A sound and control circuit 50 is fabricated upon a printed circuit board in accordance with conventional fabrication techniques and includes a sound integrated circuit device 51 and a plurality of supporting components 52. A reversing switch 53 also fabricated in accordance with conventional fabrication techniques responds to switches 83 and 93 to reverse the direction of reversible motor 60. Sound and control circuit further includes a motor drive integrated circuit 54. While not seen in FIG. 2, it will be noted with return temporarily to FIG. 1, that movement mechanism 30 includes a plurality of conventional batteries 32 within housing 31 to provide operative power for sound and control circuit 50 and reversible motor 60.

Sound integrated circuit 51 is fabricated in accordance with conventional fabrication techniques and utilizes an internal memory having stored audio data and a microprocessor having a stored instruction set to provide sound signal output. This sound signal output is applied to speaker 55 supported within housing 31. It will be recongnized by those skilled in the art, that virtually any standard speech or sound circuit may be utilized in place of circuit 51. The essential characteristic of circuit 51 is the provision of appropriate signals to speaker 55 for audiblizing a predetermined speech message or sound combination each time sound circuit 51 is energized by switch 15 (seen in FIG. 1). For example, a combination of a microprocessor, read-only memory, speech synthesizer and audio output amplifier suitable for the functioning of circuit 51 is formed as a single integrated circuit chip device manufactured by Texas Instruments, Inc. under the device name TMS50C44. However, it will be understood that a variety of standard integrated circuit devices may be utilized for circuit 51.

Motor drive circuit 54 operates to provide appropriate voltages to reversible motor 60 through reversing switch 53. The sole function of reversing switch 53 is to toggle the pularity of voltage applied to reversible motor 60. This toggling action is carried forward in response to switches 83 and 93. Switches 83 and 93 are operated in the manner set forth below in FIG. 3. However, suffice it to note here that gears 80 and 90 support respective cams which in turn manipulates switches 83 and 93 as gears 80 and 90 are rotated FIG. 3 sets forth a partial section view of movement mechanism 30 taken along section lines 3—3 in FIG. 2. As described above, a sector gear 76 is rotatably supported by a shaft 77. A gear 90 is joined to shaft 77 and rotatable therewith. Gear 90 supports a cam 95. A switch 93 is supported beneath gear 90 and is aligned with cam 95. Switch 93 is coupled to sound and control circuit 50 (seen in FIG. 2) by a plurality of connecting wires 94. Sector gear 76 further supports a flange 38 which in turn supports a forwardly and downwardly extending nose paddle 35.

As is better seen in FIG. 2, shaft 77 further supports a gear 80 on the opposite side of sector gear 76. As is also better seen in FIG. 2, a switch 83 is positioned beneath gear 80. A cam 85 is supported upon gear 80 and is oppositely oriented with respect to cam 95 supported upon gear 90. As is mentioned above, the combination of sector gear 76 and gears 80 and 90 rotate as a single unit upon shaft 77. Accordingly, as sector gear 76 is rotated by gear 75 (seen in FIG. 2), a corresponding rotation takes place by gears 80 and 90 (gear 80 seen in FIG. 2).

The cooperative function of gears 80 and 90 and cams 85 and 95 respectively is the operation of reversing switch 83 and 93. Thus, as sector gear 76 is rotated for example in the direction indicated by 96, nose paddle 35 is rotated upwardly in the direction indicated by arrow 40. As this rotation of gears 80 and 90 (gear 80 seen in FIG. 2) continues cam 95 is moved against switch 93. Once cam 95 actuates switch 93, the rotation of motor 60 (seen in FIG. 2) is reversed by the toggle action of reversing switch 53 (also seen in FIG. 2). Thereafter, gears 80 and 90 are rotated in the direction indicated by arrow 86 which in turn lowers nose paddle 35 downwardly in the direction indicated by arrow 41. As gears 80 and 90 (gear 80 seen in FIG. 2) rotate in the direction indicated by arrow 86, cam 95 moves away from switch 93. Simultaneously however, cam 85 of gear 80 moves toward switch 83. As cam 85 moves against switch 83, switch 83 is actuated producing a further reversing of motor 60 through the action of reversing switch 53 (seen in FIG. 2). As a result, the direction of motor rotation and thereby rotation of sector gear 76 is again reversed moving gears 80 and 90 once again the direction indicated by arrow 96 and again raising nose paddle 35.

This reversing action continues as cams 95 and 85 alternate in actuating their respective reversing switches 83 and 93. As a further result, the movement of nose paddle 35 and ear paddles 36 and 37 is correspondingly reversed producing the asolitory movement set forth and described above in FIG. 1.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A plush toy comprising:

a plush animal body having a head, a pair of ears, a nose, a torso and a plurality of legs;

a pair of elongated ear paddles within said ears, each of said ear paddle having an interior ear paddle end;

an elongated nose paddle extending through said head and into said nose, said nose paddle defining a nose paddle interior end;

a pair of ear paddle supports coupled to said interior ear paddle ends pivotably supporting said pair of ears for movement between raised and lowered ear positons;

a nose paddle support coupled to said nose paddle interior end pivotably supporting said nose paddle between a raised position and a lowered position;

a housing supported within said torso supporting said pair of ear paddle supports and said nose paddle support;

a battery supply and reversible motor supported within said housing and a gear drive operatively coupling said reversible motor to said nose paddle support and said pair of ear paddle supports moving said ear paddles and said nose paddle between said respective raised and lowered ear positions and said raised and lowered nose position;

a pair of reversing switches supported within said housing operative in response to movement of said pair of ear supports to reverse said motor at said raised and lowered ear positions; and a switch within said plush animal body actuated in response pressure to energize said motor.

2. The plush animal toy set forth in claim 1 wherein said housing includes a sound circuit and audio transducer providing audible sound in response to actuation of said switch.

3. The plush animal toy set forth in claim 2 wherein said pair of ear paddle supports each include a rotatable gear joined to one of said ear paddles and a pair of drive gears each including a cam for said actuation of one of said reversing switches and each coupled to said rotatable gears.

4. The plush animal toy set forth in claim 3 wherein said nose paddle support includes a sector gear coupled to said gear drive and a sector gear shaft joined to and rotatably supporting said sector gear having opposed ends joined to said drive gears.

* * * * *